United States Patent [19]

Inoue et al.

[11] Patent Number: 4,737,816

[45] Date of Patent: Apr. 12, 1988

[54] IMAGE TRANSFER DEVICE

[75] Inventors: Takahiro Inoue, Yokohama; Takao Aoki, Abiko; Yuusaku Takada; Masahiro Gotou, both of Yokohama, all of Japan

[73] Assignee: Canon Kabushiki Kaisha, Tokyo, Japan

[21] Appl. No.: 804,313

[22] Filed: Dec. 3, 1985

Related U.S. Application Data

[63] Continuation of Ser. No. 503,100, Jun. 10, 1983, abandoned.

[30] Foreign Application Priority Data

Jun. 16, 1982 [JP] Japan ..... 57-103453
Jun. 16, 1982 [JP] Japan ..... 57-103454

[51] Int. Cl.[4] ..... G03G 15/14; G03G 21/00

[52] U.S. Cl. ..... 355/3 TR; 271/310; 355/3 SH

[58] Field of Search ..... 355/3 R, 3 TR, 3 SH, 355/3 CH, 14 TR, 14 SH; 371/307, 310

[56] References Cited

U.S. PATENT DOCUMENTS

| | | | |
|---|---|---|---|
| 3,860,857 | 1/1975 | Namiki et al. | 355/3 TR X |
| 3,976,370 | 8/1976 | Goel et al. | 355/3 TR |
| 4,023,894 | 5/1977 | Goel | 355/3 TR |
| 4,063,724 | 12/1977 | Suda | 271/277 |
| 4,077,709 | 3/1978 | Borostyan et al. | 355/3 TR |
| 4,087,170 | 5/1978 | Sawaoka et al. | 355/3 CH |
| 4,165,165 | 8/1979 | Iwami | 355/4 |
| 4,415,256 | 11/1983 | Inoue | 355/3 |

FOREIGN PATENT DOCUMENTS 2930568 2/1980 Fed. Rep. of Germany .

OTHER PUBLICATIONS

Hayne, Thomas F., "Corotrons for Charge Reduction at Transfer Roll Stripping", Xerox Disclosure Journal; vol. 1, No. 8; Aug. 1976, p. 55.

*Primary Examiner*—Fred L. Braun
*Attorney, Agent, or Firm*—Fitzpatrick, Cella, Harper & Scinto

[57] ABSTRACT

An image transfer device includes a member for carrying a transfer material thereon and an image bearing member having an image thereon, the transfer material carrying member being subjected to a transfer corona therethrough to transfer the image from the image bearing member onto the transfer material. When the transfer material is separated from the transfer material carrying member by a separation pawl, that portion of the transfer material carrying member from a position in which the transfer material is in close contact with the carrying member to another position in which the transfer material is separated from the carrying member by the separation pawl is charged by a pair of corona chargers with the transfer material carrying member being located therebetween, so that the transfer material can more readily be separated from the carrying member.

8 Claims, 4 Drawing Sheets

IMAGE TRANSFER DEVICE

This application is a continuation of application Ser. No. 503,100 filed June 10, 1983 now abandoned.

BACKGROUND OF THE INVENTION

1. Field of the Invention

The present invention relates to an image transfer device comprising a member for carrying a transfer material thereon and an image bearing member having an image thereon, the transfer material carrying member being subjected to a transfer corona therethrough to transfer the image from the image bearing member onto the transfer material. Particularly, the present invention relates to an image transfer device of the above type which can make the separation of the transfer material from the carrying member easier after transfer.

2. Description of the Prior Art

In the prior art image transfer devices of the above type, it is known that the separation of a transfer material from a carrying member can be assisted by precharging, with corona, that side of the carrying member faced to the transfer material or the opposite sides of the same.

It is, however, difficult to obtain consistently good separation under various conditions, such as the degree of humidity, the use of transfer paper and overhead projector film and so on.

There is also the further problem that upon separating, a toner image on the transfer material tends to be disturbed resulting in the scatter of toner particles. In a multiple transfer device which comprises a rotatable member for carrying a transfer material thereon and a member bearing an image thereon that will be transferred onto the transfer material to form a superposed image by applying a transfer corona to the transfer material through the carrying member several times, toner particles in the topmost layer of the image may scatter or move rearwardly in the direction of movement of the transfer material.

It is also known that the transfer material carrying member is subjected to a corona charge at one side or the opposite sides for various purpose, for example, to prevent the transfer material carrying member from charging up on termination of each transfer, to facilitate the cleaning of the carrying member or to clean the carrying member in an electrostatic fashion.

Such an arrangement just mentioned requires one or two additional chargers and then an expensive high-voltage generating device.

The chargers must be disposed at a position in which the transfer material is positioned after it has been separated from the carrying member and before the latter is cleaned or at a position prior to supply of the next transfer material. A space receiving these chargers is therefore limited so that the transfer device will be increased in size.

In such a multiple transfer device as mentioned above, it is known that corona charging is applied to a transfer material carrying member at one side or the opposite side to prevent the carrying member from charging up upon completion of each transferring. Where the transfer material carrying member is made of a perforated screen having high resistance, however, the first copying or printing after a rest provides a reduced electrostatic force attracting the transfer material to the carrying member in comparison with the continuous copy or print. It has been found that the reduced electrostatic attracting force results in incorrect registration at transfer. This also brings about a deviation in color for multi-color copy or print. This problem tends to take place, particularly, in the condition of lower humidity.

SUMMARY OF THE INVENTION

It is an object of the present invention to provide an image transfer device which does not have the above-mentioned disadvantages as in the prior art and which can provide a desirable charging for separation under any humidity independently of the property of transfer material, so that the separation can more smoothly be effected without any disturbance of toner image upon separation and subsequent processes.

The present invention provides an image transfer device which includes a member for carrying a transfer material thereon and an image bearing member having an image thereon, the transfer material carrying member being subjected to a transfer corona therethrough to transfer the image from the image bearing member onto the transfer material and which is characterized in that when the transfer material is separated from the transfer material carrying member by a separation pawl, corona charge is applied from a position in which the transfer material is in close contact with the carrying member to another position in which the transfer material is separated from the carrying member by the separation pawl by a pair of corona chargers with the transfer material carrying member being located therebetween, whereby the transfer material can more readily be separated from the carrying member.

Thus, the arrangement according to the present invention can prevent a toner image on a transfer material from scattering or deviating upon separation of the transfer material since the latter is charged in the region between a position in which the transfer material is in close contact with a transfer material carrying member and another position in which the transfer material is separated from the carrying member. The present invention further provides an action for removing charges on the surface of the transfer material carrying member without need of any specific cleaning means. This assures that the space can be saved, that the transfer device can more easily be designed and that the transfer device can be reduced in size. There can be decreased offsetting which may be produced in the multiple transfer operation. In addition to the reduction of size in the transfer device, the corona generating device can be powered down. Furthermore, the transfer device according to the present invention can eliminate any incorrect registration at transfer or any deviation in color for multi-color copy and print.

DESCRIPTION OF THE PREFERRED EMBODIMENTS

Figure 1:
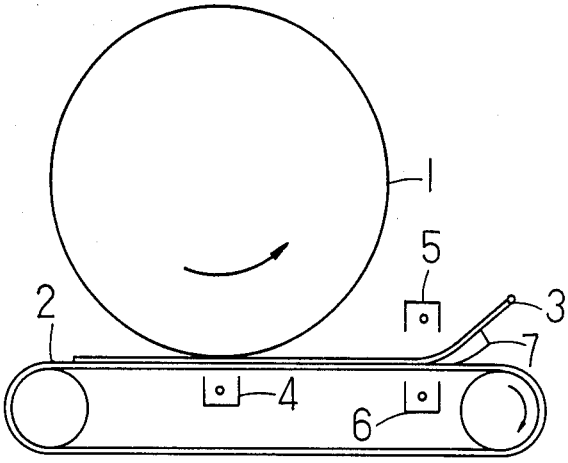
FIG. 1 is a schematic side view of a transfer device.

Referring to FIG. 1, an image bearing member 1, such as a photosensitive drum, retains a toner image thereon in an electrostatic fashion. A transfer material carrying member 2 is in the form of a sheet or screen which is made of polyester, triacetate, Teflon (trade mark), nylon, polyethylene, fiberglass, paper or one of the above materials into which any suitable resistance controlling agent is mixed. The toner image on the image bearing member 1 is transferred onto a transfer material 3 carried by the carrying member 2 under the action of a transfer charger 4 which is disposed behind the carrying member 2. At this time, the transfer material 3 is strongly attracted to the carrying member 2 under the influence of an electrostatic force. In order to separate the transfer material 3 from the carrying member 2 under such a circumstance, there are provided a separation pawl 7 and corona chargers 5 and 6 which chargers are located at the opposite sides of the transfer material carrying member. These corona chargers 5 and 6 neutralize charges on the transfer material 3 and carrying member 2 while at the same time the separation pawl 7 separates the transfer material 3 from the carrying member 2. The application of the corona chargers 5 and 6 should be in the range between a position in which the transfer material 3 is in close contact with the carrying member 2 and a position in which the transfer material is separated from the carrying member 2. The corona charger 5 is energized by a direct current having the same polarity as in the transfer charger 4, an alternating current superposed with the above direct current or alternating current. On the other hand, the corona charger 6 is energized by a second direct current having the opposite, polarity to that of the transfer charger 4, an alternating current superposed with the second direct current or alternating current. These currents may be controlled by a grid structure. It has been found that both the corona chargers 5 and 6 can most preferably be operated by two different alternating currents which are out of phase relative to each other oppositely, i.e. by 180°. This is accomplished by providing the opposite inputs to a high-voltage AC transformer.

After being separated from the carrying member 2, the transfer material 3 is moved to a step for fixing a toner image thereon. The carrying member 2 is adjusted with respect to the distribution of charge at the opposite sides in the above separating charge step. As a result, the carrying member is nulled in charge-up and then cleaned if required, followed by the next transport and transfer step. In this connection, the carrying member will not be charged prior to the cleaning step.

Figure 2A:
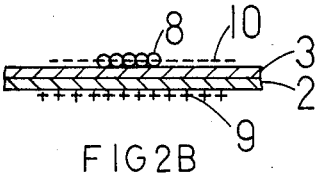
FIGS. 2A, 2B, 2C and 2D illustrate various states of charge on a transfer material and carrying member.

FIG. 2A shows such a state that a toner image has been transferred onto the transfer material. In FIG. 2A, the toner image transferred onto the transfer material 3 is designated by reference numeral 8. In the following description it is assumed that the toner has a negative polarity. When the carrying member 2 is subjected to the transfer corona radiation (application) from the transfer charger 4 (FIG. 1), positive charge 9 is applied to the inner face of the carrying member 2. On the other hand, the toner image 8 having its negative polarity transfers onto the outer surface of the transfer material 3 under the action of the same positive charge. At the same time, the outer surface of the transfer material 3 also receives negative charge 10 produced at the separation discharge when the transfer material 3 is separated from the image bearing member 1 (FIG. 1). As a result, the inner surface of the carrying member 2 becomes charged with positive polarity while the outer surface of the transfer material 2 becomes charged with negative polarity, as shown in FIG. 2A. The density of charge is higher at the toner image and lower at the other area. Thus, the potential is substantially uniformly distributed with positive charge.

Figure 2B:
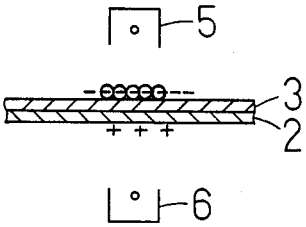
Figure 2D:
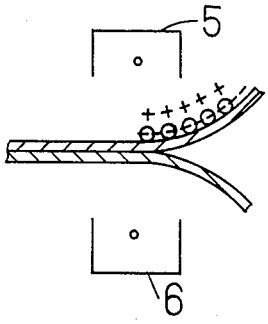

Subsequently, the chargers 5 and 6 are energized to neutralize the surfaces of the transfer material 3 and carrying member 2 to remove the charge. As seen from FIG. 2B, an area having no toner is subjected to the action of charge elimination at both sides so that the charge thereon will be dissipated. On the other hand, the other area having the toner receives positive charge to negate the charge of the toner which had provided thereto. As a result, the surface potential becomes substantially equal to zero throughout the surface. (Strictly speaking, there is a small fluctuation of potential due to unevenness in charge or other minor effects. This fluctuation can be neglected since it does not influence the general situation.)

Figure 2C:
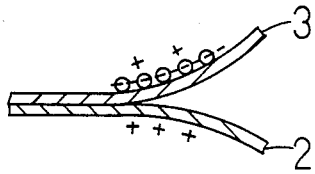

If the transfer material 3 is separated from the carrying member 2 as by the separation pawl 7 after both are placed in the above state, the toner of negative polarity deviates rearwardly since it is attracted to the inner surface of the carrying member 2 by the positive charge thereon, as shown in FIG. 2C. Alternatively, the toner image may be disturbed due to a high voltage produced on separation of the transfer material from the carrying member. At this time, a pattern of potential appears on the transfer material 3 and carrying member 2 to charge the inner face of the transfer material and the outer face of the carrying member due to the separation discharge. If the action of the corona chargers 5 and 6 extends from a position in which the transfer material 3 is in close contact with the carrying member 2 to a position in which the transfer material is separated from the carrying member 2 by the separation pawl 7, the unbalanced charge produced on separation is always brought into a balanced state as shown in FIG. 2A, under the influence of the corona charging. The charge on the carrying member is therefore dissipated to neutralize the toner charge on the transfer material resulting in a more stable separation.

It is understood from the foregoing that this charging also serves to clean the surface of the carrying member 2 with respect to charge. In FIG. 2C, the separation creates a new pattern of potential on the carrying member 2. This may result in a ghost on transfer. In the prior art, therefore, a subsequent electrostatic cleaning step is required to eliminate such a ghost, but in the embodiment described above this is not required.

Thus, a smooth separation can be attained by providing the separation chargers 5 and 6 which are disposed to provide the corona irradiation in the range between a position in which the transfer material 3 is in close contact with the carrying member 2 and a position in which the transfer material 3 is separated from the carrying member 2 for a purpose of neutralizing the charge on the transfer material 3 and carrying member 2 when they are to be separated from each other. In order to make such a separation more smooth, however, the charging is preferably stopped when the charge is neutralized.

Where the surrounding humidity is lower or higher or when a transfer material is a sheet of paper or a film used in a certain overhead projector, the transfer material and carrying member may be under-neutralized or over-neutralized. The over-neutralization charges them to the opposite polarity. Consequently, the toner image on the transfer material will be disturbed in separation. Alternatively, a portion of the charge on the transfer material migrates to a guide plate in a fixing step or a transport step after separation so that the toner image will be disturbed.

In order that a desirable separating charge can always be obtained for different properties of transfer material and/or under different conditions of humidity, the aforementioned transfer device may be provided with a pair of corona chargers which are variable in output independently of each other and disposed at the opposite sides of the transfer material carrying member. Similarly, these corona chargers serve to irradiate the carrying member in the range between a position in which the transfer material is in close contact with the carrying member and a position in which the transfer material is separated from the carrying member.

The transfer material and carrying member may be of the same material of different materials from each other. For example, the transfer material may be made of a transparent film such as nylon sheet or others although it is normally of paper. Although the transfer material carrying member may be made of the same material, it cannot simply be replaced even if the transfer material is changed in material.

Consequently, the transfer material is interrelated with the carrying member in electrostatic capacity (charge acceptability) under at least two conditions among three conditions that the transfer material is larger than, equal to and smaller than the carrying members with respect to the electrostatic capacity. For example, if the carrying member is of polyester film and the transfer material is of paper, the transfer material is smaller than the carrying member with respect to the electrostatic capacity. If the transfer material and carrying member are of polyester film, the electrostatic capacity of the transfer material is equal to that of the carrying member. If there is a fluctuation of electrostatic capacity depending upon the materials used, it is required that the outputs of the separation chargers are varied independently of each other to make the charging constant with respect to both the transfer material and carrying member. If the carrying member is of polyester film and the transfer material is of paper, it is preferred that the separation charger 5 has its power smaller than or equal to that of the separation charger 6. If the transfer material and carrying member are of polyester film, it is required that the separation charger 5 has its power smaller than that of the separation charger 6 while at the same time the powers of both the transfer material and carrying member are larger than those in the case that the carrying member is of polyester film and the transfer material is of paper. This is because it is required that the power of the separation charger 6 must be larger than that of the separation charger 5 since charge is deposited on the inner face of the carrying member due to corona and the resulting secondary charge is deposited on the transfer material so that the charging will be unsaturated and unbalanced throughout the transfer material and carrying member. It is further required that the overall charging is increased since the electrostatic capacity (charge acceptability) is increased throughout as the transfer material and carrying member are considered as a unit, in comparison with the case where the transfer material is of paper and the carrying member is of polyester film.

With a fluctuation of humidity, polyester is unvaried in both electric resistance and electrostatic capacity while paper is varied in both electric resistance and electrostatic capacity. If the transfer material is of paper and the carrying member is of polyester, when the systems are regulated for a good separation with 60% RH (relative humidity), the discharging of paper will insufficiently be effected, when the humidity becomes 30% RH. In order to overcome such a problem, it is required that the upper separation charger is increased in power while at the same time both the separation chargers are increased in power.

By providing a pair of separation chargers which can be varied in power independently of each other, the toner image will not be disturbed on separation step and subsequent steps.

Figure 3A:
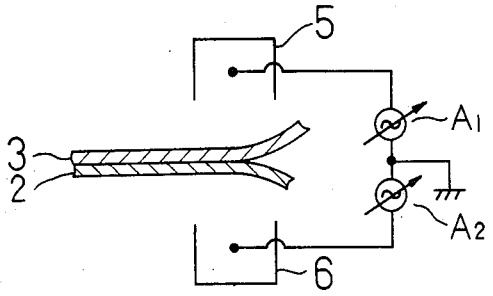
FIGS. 3A, 3B and 3C show embodiments of separation chargers in a transfer device according to the present invention, all of which are variable in output.
Figure 3B:
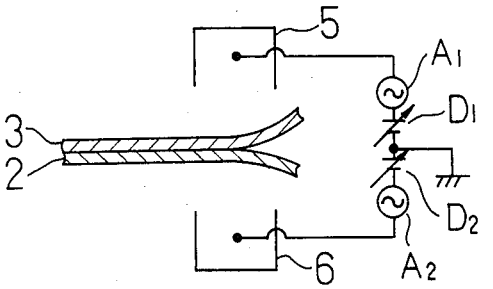
Figure 3C:
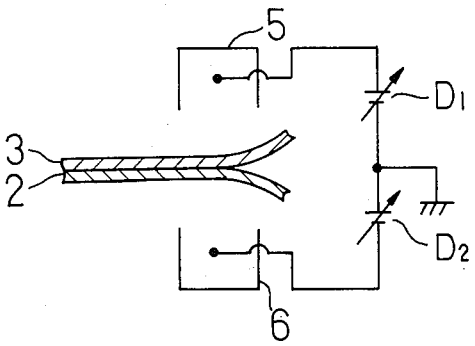

Embodiments of a set of variable separation chargers 5, 6 according to the principle of the present invention are shown in FIGS. 3A, 3B and 3C. FIG. 3A shows an arrangement in which the separation chargers 5 and 6 are energized by alternating currents from the respective sources $A_1$ and $A_2$ which are variable independently of each other. FIG. 3B shows another arrangement having sources of alternating current $A_1$, $A_2$ and sources of direct current $D_1$, $D_2$ each of which is variable independently of the others. FIG. 3C shows still another arrangement including sources of direct current $D_1$ and $D_2$ which are variable independently of each other.

Figure 4:
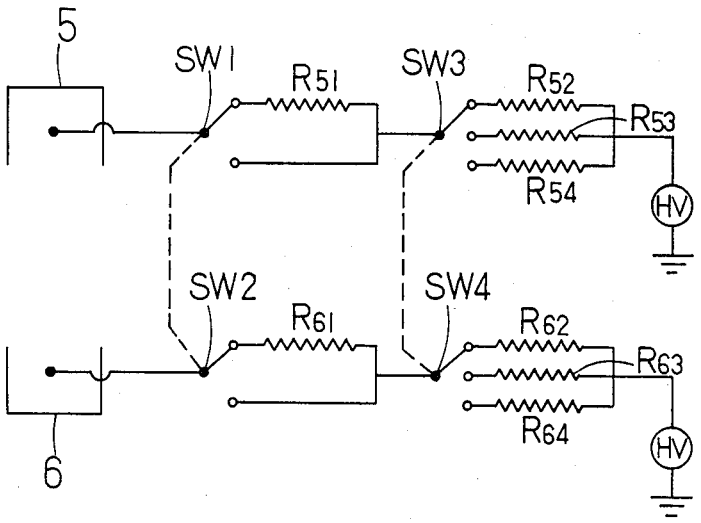
FIG. 4 is a circuit diagram of a concrete example of means for varying the output of the separation chargers.

A concrete example of an apparatus for varying the outputs of the separation chargers 5 and 6 in the above-mentioned manner is shown in FIG. 4. In this figure, HV is a source of high voltage, $R_{51}$–$R_{54}$ and $R_{61}$–$R_{64}$ are resistors, and SW1–SW4 are change-over switches. The change-over switches SW1 and SW2 are used to change the outputs of the chargers depending on whether the transfer material is of paper or overhead projector (OHP) film. Therefore, each of the resistors $R_{51}$, $R_{61}$ is interchanged with the other to provide a predetermined output. These resistors $R_{51}$ and $R_{61}$ are normally different from each other in resistance. On the other hand, the change-over switches SW3 and SW4 are used to change the outputs of the separation chargers depending on whether the surrounding humidity is low, normal or high. The sets of resistors ($R_{52}$, $R_{62}$; $R_{53}$, $R_{63}$; $R_{54}$, $R_{64}$) are different from each other in value. The change-over switches SW1, SW2 or SW3, SW4 are operatively associated with each other. Although the pair of change-over switches are simultaneously operated, each of the upper and lower separation chargers 5 and 6 is set at the desired value independently of the other since the resistors having different values are provided in connection with the corresponding switches. This results in a simple operation to obtain substantially desirable outputs.

A multiple transfer device to which the abovementioned principle of the present invention is applied will now be described. Transfer material carrying member may be a perforated screen of polyester, triacetate, Teflon (trade mark), nylon, polyethylene, fiberglass, paper or one of the above materials into which any suitable resistance controlling agent is mixed. On operation, the carrying member 2 is irradiated by the corona chargers 5 and 6 at the opposite sides. This irradiation is continued until the carrying member 2 is moved over a complete cycle. The irradiation will thereafter be provided upon each separation of the transfer material. As described hereinbefore, the corona charger 5 is energized by a direct current having the same polarity as in the transfer charger 4, an alternating current superposed with this direct current or alternating current, while the corona charger 6 is energized by a direct current having the opposite polarity to that of the transfer charger 4, an alternating current superposed with the direct current or alternating current. These currents may be controlled by a grid. It has been found that good results can be obtained by using two separation chargers which are energized by two alternating currents different from each other in phase inversely, that is, by 180°. This is accomplished by providing the opposite inputs to a high-voltage AC transformer.

After the transfer material carrying member 2 is initialized by subjecting to the irradiation from the chargers 5 and 6 at the inner and outer faces of the carrying member, a transfer material 3 is placed on the surface of the carrying member 2, and attracted by charging the latter to provide an electrostatic attraction, if required. Subsequently, a toner image on the image bearing member 1 is transferred onto the transfer material 3 carried by the carrying member 2 under the action of the transfer charger 4 which is disposed behind the inner face of the carrying member 2. At this time, the transfer material 3 is strongly attracted to the carrying member 2 under the influence of an electrostatic force. Subsequently, the transfer material 3 and carrying member 2 are neutralized with respect to charge by the corona chargers 5 and 6 which are disposed at the opposite sides of the carrying member. Thus, the transfer material 3 can readily be separated from the carrying member 2 by means of the separation pawl 7. The corona chargers 5 and 6 are energized for the period of time between a point immediately before the transfer material is separated from the carrying member and a point after the separation of the transfer material has been terminated.

The application range of the corona chargers 5 and 6 should be from a position in which the transfer material 3 is in close contact with the carrying member 2 to a position in which the transfer material is separated from the carrying member. Thus, the transfer material 3 proceeds to a fixing step after it has been separated from the carrying member, while the carrying member is adjusted with respect to the distribution of charge at the opposite sides and then proceeds to the subsequent transport and transfer step. The charging is not required for facilitating the cleaning step. The application positions and effects of the corona chargers are similar to those described hereinbefore in connection with FIG. 2.

In the multiple transfer device aforementioned, the carrying member can proceed to the next transfer step without need of any specific cleaning charge in a continuous transfer mode since it is cleaned under the action of the separation chargers 5 and 6. Where the surrounding humidity is low and after a rest, however, the electrostatic force for attracting the transfer material to the carrying member decreases in the first copying or printing operation in comparison with the continuous copying or printing mode if the carrying member is in the form of a perforated screen having high resistance, as described hereinbefore. This results in undesirable problems of an incorrect registration at transfer or a deviation in color (in the case of a multi-color copy or print). This is because the charges on the opposite sides of the carrying member 2 is not completely removed by the corona charging means. The charge on the carrying member 2 at one side is normally different from that on the other side thereof in polarity and charge density. At the normal condition of humidity, such an unbalanced state is hard to produce. However, it may more easily produce if the humidity is lower. Even in the continuous transfer mode, this problem is present, but can be neglected since the copying is continued without any change of transfer condition to provide a certain stable transfer operation. During a rest, however, some charge may migrate along the surface of the screen in spite of the high resistance thereof to negate the unbalanced distribution of charge, resulting in any change of charge distribution throughout the opposite sides of the carrying member. Consequently, the transfer condition will vary to provide an incorrect registration at transfer or a deviation in color.

The illustrated embodiments provide the second feature in that the corona chargers 5 and 6 can be operated to eliminate the above-mentioned problem even at the beginning of copying operation.

Figure 5:
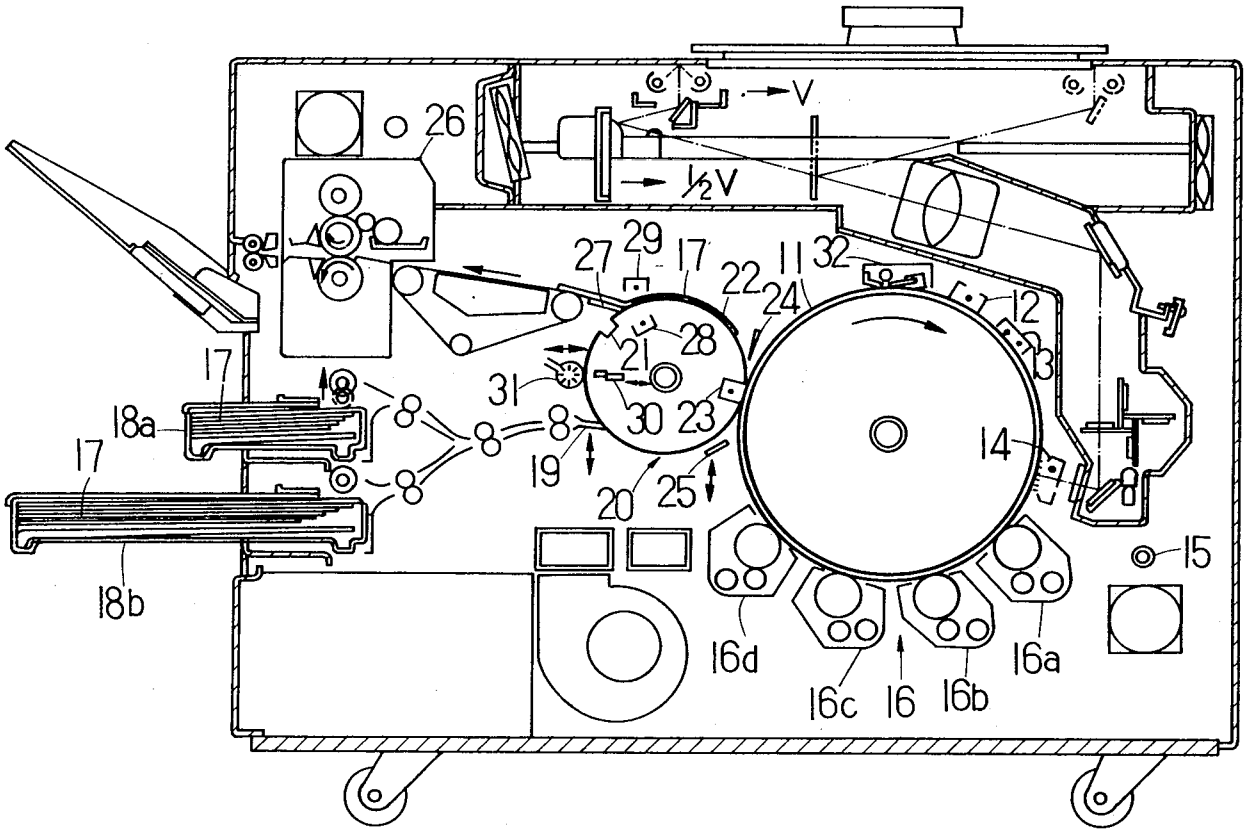
FIG. 5 is a side view of a copying machine to which the present invention is applied.

FIG. 5 shows a copying machine including the above transfer device according to the present invention and which can be used in a single color copying operation as well as a multi-color copying operation. The description will be described with reference to the multi-color copying operation.

In FIG. 5, reference numeral 11 denotes an electrophotographic type photosensitive drum having an insulating surface layer and being rotatably supported. Upon receiving a copy instruction, the photosensitive drum begins to rotate in the direction shown by an arrow. When the drum 11 is rotated to a predetermined rotational position, an optical image reflected from an original on an original carriage of glass is passed through a lens, color-separated by resolving filter means and then imaged on the drum 11.

The drum 11 is discharged by a discharger 12 and then charged by a primary charger 13, for example, to positive polarity. Thereafter, the drum 11 is exposed to the image through a slit. At the same time, the drum 11 is discharged by a discharger 14 to have a polarity opposite to that of the alternating current or the primary current, for example, minus polarity. Thereafter, an electrostatic latent image having a high contrast is formed on the drum 11 by subjecting the latter to a whole surface exposure from a whole surface exposure lamp 15.

The electrostatic latent image on the photosensitive drum 11 is then developed to provide a toner image by means of a development assembly 16. The development assembly 16 consists of four developing devices **16*a*, 16*b*, 16*c* and 16*d* providing yellow-, magenta-, cyan- and black-colored toners, respectively. Any developing device is operated corresponding to the color-separation filter used at exposure to provide a toner image having the required color. In color copying, the first development is effected at the yellow-colored developing device 16*a***.

A transfer material 17 is supplied from a cassette **18*a* or 18*b* and then transported to the surface of a transfer material carrying member, that is, transfer drum 20 through a feed guide 19 whereat the leading edge of the transfer material 17 is grasped by a gripper 21 formed on the transfer drum 20**.

While the development is carried out at the yellow developing device **16*a* as described above, separation chargers 28 and 29 are energized at the transfer drum 20** to initialize the surface of a screen 22 on the transfer drum 20 with respect to charge. If required, cleaners 30 and 31 are energized at the same time or before or after the separation chargers 28 and 29 are operated.

The transfer material grasped by the gripper 21 on the transfer drum 20 is wound about and transported along the screen 22 located over the transfer drum 20 as the latter is rotated. As the transfer material 17 passes through between a transfer charger 23 and the photosensitive drum 11, the yellow-colored toner image is transferred from the photosensitive drum 11 onto the transfer material while holding the latter on the screen surface under the action of an electrostatic attraction force. At this time, the electrostatic force attracting the transfer material 17 to the screen 22 is increased under the action of a needle electrode 24. At the first transfer step, the transfer material 17 is electrostatically attracted to the screen first at the transfer charger 23. Before the transfer material reaches the transfer charger 23, the force holding the transfer material is lower so that it can be pulled by the photosensitive drum 11 resulting in a deviation in color. In order to avoid this, the copying machine includes a holding plate 25. The holding plate 25 and the feed guide plate 19 are adapted to move away from the transfer drum 20 after the first transfer sheet has moved past these plates. The screen 22 is rotated holding the transfer material 17 and proceeds to the next transfer cycle.

Subsequently, a magenta-colored toner image is formed on the photosensitive drum 11 by means of the magenta developing device **16*b* and then transferred onto the transfer material 17 over the yellow-colored toner image which has already been transferred thereon in the preceding transfer cycle, by means of the transfer charger 23. Further, a cyan-colored toner image is transferred over the magenta-colored toner image by means of the cyan developing device 16*c***.

After various toner images have been transferred onto the transfer material 17, the latter is separated from the screen 22 on the transfer material carrying member, that is, the transfer drum 20 and then fed to a fixing device 26 whereat the toner images are fixed to the transfer material before the latter is exhausted outside.

At the separation position in which the transfer material 17 is separated from the screen 22, there are disposed a separation pawl 27 and corona chargers 28 and 29 which correspond to the separation pawl 7 and the corona chargers 5 and 6, respectively. In FIG. 5, 30 and 31 are cleaners for cleaning any remaining toner particles from the opposite sides of the screen 22, and 32 is a cleaner for cleaning the photosensitive drum 11. As the leading edge of the transfer material 17 approaches the separation area, the gripper 21 is released, the separation chargers 28 and 29 are energized and the separation pawl 27 is moved to the screen 22 to separate the transfer material 17 therefrom.

High AC voltages having phases opposite to each other are applied to the separation chargers 28 and 29 so that the effect of discharging can be improved by reduced voltages in comparison with those in the case of applying voltages with the same phase. For example, although voltages to be applied must be about 8 KV at the same phase, at most 5 KV of voltages may be applied at the opposite phases. This means that each of the chargers may be reduced in size as well as the high-voltage transformer with a reduced danger associated with any spark discharging.

The application range of the separation chargers 28 and 29 is the area between a position in which the transfer material 17 is in close contact with the screen 22 and a position in which the transfer material 17 is separated from the screen 22, as described hereinbefore. In addition to the advantages described in connection with the single color copying operation, this provides additional advantages in that the toner particles on the topmost layer can be prevented from scattering and from migrating rearwardly in the direction of movement of the transfer material.

Each of the chargers is directed away from the transfer material 17 and screen 22 to decrease the application of charge gradually. This is because any excessive charging is prevented from being produced even after the transfer material and screen have been neutralized in charge and because any abrupt fluctuation of electric field is avoided since the force attracting the toner to the transfer material is reduced after the separation of the transfer material from the screen. The gradual reduction of charge may be accomplished even by varying any additional grid in density or by changing the bias applied to the additional grid in addition to the aforementioned chargers.

The separation chargers 28 and 29 are adapted to operate through a portion of the cycle between immediately before the transfer material is separated from the screen and after the former has been separated from the latter rather than another portion of the cycle that the transfer step is continued. Otherwise, the force attracting the toner to the transfer material would be decreased to more easily offset the preceding toner image relative to the photosensitive drum at the next transfer cycle.

If the transfer material carrying member is in the form of a screen, the transfer corona charges not only the screen but also the inner surface of the transfer material so that the rate of transfer will substantially be unvaried even during the second and subsequent transfer steps in comparison with the first transfer step. Therefore, the continued operation of chargers 28 and 29 is not required and rather maybe harmful. Any offset in the multiple transfer cycle can be reduced by providing the transfer material carrying member in the form of a screen, by operating the separation chargers 28 and 29 through the area within the range between a position immediately before the transfer material is separated and a position after the transfer material has been separated, and by irradiating the transfer material and carrying member through the range between a position in which the transfer material is in close contact with the carrying member and a position in which the transfer material is separated from the carrying member.

As described hereinbefore, the separation chargers also provide additional cleaning action for removing any charge from the surface of the carrying member. This cleaning action further provides another function for preventing any charge-up on the screen to hold the electrostatic attracting force constant under the same condition of transfer. Moreover, the additional cleaning action facilitates removal of any remaining toner particles from the screen.

Although the additional cleaning action can be obtained if the transfer material carrying member is a sheet, it is preferred that the carrying member is in the form of a perforated screen since the carrying member is charged through the perforation of the screen to equalize the distribution of charge throughout the opposite sides of the carrying member.

In the prior art, one or two chargers are provided between the separation chargers 28, 29 and the cleaners 30, 31 to avoid the charge-up on the carrying member. As seen from FIG. 5, a space in which the additional chargers is to be located is very small so that the transfer device will be increased in size. According to the present invention, the charger(s) for preventing the charge-up can be omitted.

The separated transfer material 17 is heated in a fixing device 26 for fixing the toner images thereto. After the transfer screen has been cleaned at the opposite sides by means of the cleaners 30 and 31, the next transfer step is initiated.

In addition, the chargers 28 and 29 are variable in output independently of each other to freely change their outputs depending on the different conditions of charging, so that a more smooth separation can be accomplished.

What is claimed is:

1. An image transfer device comprising:

an image bearing member;

transfer means for transferring an unfixed toner image from said image bearing member onto transfer material and including a transfer charger for applying a charge to the toner image;

a transfer material carrying member for carrying said transfer material to said transfer means;

separation means for separating said transfer material bearing an unfixed toner image from said transfer material carrying member;

a first corona discharger for applying corona charge having a component of polarity opposite to that of the toner image to the unfixed toner image throughout a range between a position at which the transfer material is in contact with said transfer material carrying member and a position at which said transfer material is separated from said transfer material carrying member by the action of said separation means; and a second corona discharger for applying charge having a component of polarity opposite to the polarity applied by said first corona discharger to that side of said transfer material carrying member opposite to the side thereof carrying the transfer material and throughout said range; wherein said first and second corona dischargers are variable in output independently of each other, and whereby the separation of the transfer material from said transfer material carrying member takes place while the unfixed toner image is acted upon by said first and second corona dischargers.

2. An image transfer device as defined in claim 1 wherein said transfer material carrying member is in the form of a perforated screen.

3. An image transfer device comprising:

an image bearing member;

transfer means for transferring an unfixed toner image from said image bearing member onto transfer material and including a transfer charger for applying a charge to the toner image;

a transfer material carrying member for carrying said transfer material to said transfer means;

separation means for separating said transfer material bearing an unfixed toner image from said transfer material carrying member;

a first corona discharger for applying corona charge having a component of polarity opposite to that of the toner image to the unfixed toner image throughout a range between a position at which the transfer material is in contact with said carrying member and a position at which said transfer material is separated from said transfer material carrying member by the action of said separation means; and a second corona discharger for applying charge having a component of polarity opposite to the polarity applied by said first corona discharger to that side of said transfer material carrying member opposite to the side thereof carrying the transfer material and throughout said range;

whereby the separation of the transfer material from said transfer material carrying member takes place while the unfixed toner image is acted upon by said first and second corona dischargers.

4. An image transfer device as defined in claim 3 wherein said separation means is in the form of a separation pawl.

5. An image transfer device as defined in claim 3 wherein each of said corona dischargers is in the form of an AC corona discharger.

6. An image transfer device as defined in claim 5 wherein the respective alternating currents used in said AC corona dischargers are out of phase by 180°.

7. An image transfer device as defined in claim 3 wherein one of said corona dischargers is energized by a direct current having the same polarity as said transfer means while the other corona discharger is energized by another direct current having a polarity opposite to that of said transfer means.

8. An image transfer device as defined in claim 3 wherein one of said corona dischargers is energized by a direct current having the same polarity as said transfer means and an alternating current superposed with said direct current while the other corona discharger is energized by a second direct current having a polarity opposite to that of said transfer means and an alternaitng current superposed with the second direct current.

* * * * *

UNITED STATES PATENT AND TRADEMARK OFFICE

CERTIFICATE OF CORRECTION

PATENT NO. : 4,737,816

DATED : April 12, 1988

INVENTOR(S) : TAKAHIRO INOUE, ET AL.

It is certified that error appears in the above-identified patent and that said Letters Patent is hereby corrected as shown below:

Column 1, line 44, "purpose," should read --purposes,--.

Column 3, line 36, "opposite," should read --opposite--.

Column 4, line 4, "material 2" should read --material 3--;

line 16, "which had" should read --which had been--.

Column 10, line 42, "maybe" should read --may be--.

Signed and Sealed this

Twenty-seventh Day of September, 1988

*Attest:*

DONALD J. QUIGG

*Attesting Officer*

*Commissioner of Patents and Trademarks*